United States Patent [19]

Brucher

[11] Patent Number: 4,651,477

[45] Date of Patent: Mar. 24, 1987

[54] WHEEL ASSEMBLY FOR AN ABRASIVE BLASTING APPARATUS

[76] Inventor: Melvin J. Brucher, 612 E. Highland Ave., Naperville, Ill. 60540

[21] Appl. No.: 837,795

[22] Filed: Mar. 10, 1986

[51] Int. Cl.[4] ..... B24C 5/06

[52] U.S. Cl. ..... 51/434; 51/432

[58] Field of Search ..... 51/431, 432, 433, 434, 51/435; 241/275

[56] References Cited

U.S. PATENT DOCUMENTS

| | | | |
|---|---|---|---|
| 15,309 | 7/1856 | Tyler . | |
| 1,364,831 | 1/1921 | Campbell . | |
| 2,204,635 | 6/1940 | Turnbull | 51/435 |
| 2,205,414 | 6/1940 | Keefer | 51/432 |
| 2,212,451 | 8/1940 | Peik | 51/434 |
| 2,385,728 | 9/1945 | Potter . | |
| 4,395,851 | 8/1983 | Watts | 51/435 |
| 4,521,996 | 6/1985 | Grund | 51/435 |

FOREIGN PATENT DOCUMENTS

| | | | |
|---|---|---|---|
| 1189099 | 9/1959 | France | 51/431 |

*Primary Examiner*—Frederick R. Schmidt
*Assistant Examiner*—Robert A. Rose
*Attorney, Agent, or Firm*—John W. Harbst

[57] ABSTRACT

A wheel assembly including a rotatably driven runner-head comprised of one or more plate-like members having a series of radially disposed blades or vanes adjustably secured thereto. The vanes are accomodated within blade slots or grooves which extend across the radial width of each plate-like member. Each plate-like member has two side surfaces, a rim joined to the side surfaces and defining the diamater of the plate-like member, and at least one chamfer or bevel which joins one side surface to the rim. In the area of the blade slot runout, radii are provided to enhance the wear characteristics of the wheel assembly.

6 Claims, 6 Drawing Figures

22
18
40
24
38
32
30

WHEEL ASSEMBLY FOR AN ABRASIVE BLASTING APPARATUS

FIELD OF THE INVENTION

This invention generally relates to Abrasive Blasting Machines and, more particularly, to a wheel assembly used in combination with such machines for propelling abrasive grit against metal parts whereby cleaning same.

BACKGROUND OF THE INVENTION

Grit fed blast wheels having a plurality of radially disposed vanes for centrifugally propelling abrasive material grit against parts whereby cleaning same are known in the art. Such wheels generally propel abrasive grit having an RC hardness ranging from 54 to 62. The useful life of such wheels may extend between 5,000 and 10,000 hours depending on the type of grit and the rebound from the objects being blasted.

Although the plate members comprising the wheel assembly are case hardened, a problem exists in industry because of the short useful life of such wheel assemblies. It has been found that the discs of the wheel assembly usually start to wear on the outermost rim as a result of rebounding grit. As soon as the wear penetrates or exceeds the case hardened depth of the wheel or disc, wear is rapid because of the soft core steel underlying the case hardening. Moreover, the wear pattern on the wheels is usually uneven. As a result of the uneven wear, the rotating wheel becomes unbalanced causing severe vibration to the machine. The only remedy is to replace the wheel. The high cost and downtime incurred in replacing the wheel assembly are apparent. Because of the high cost of each wheel assembly and the machine downtime incurred in replacing such a wheel assembly, even a relatively small percent increase in wearability and thus machine operation will quickly offset the added expense of a new wheel assembly.

SUMMARY OF THE INVENTION

In view of the above, the present invention offers a new wheel assembly design having a unique profile, which, when combined with other unique features of the present invention, offers an extended useful life to the wheel assembly. More particularly the wheel assembly of the present invention includes a rotatably driven runnerhead comprised of one or more disc-like members having a series of radially disposed vanes. The innermost ends of the vanes terminate short of the axis of rotation of the wheel assembly. The vanes are accomodated within slots or grooves which extend across the radial width of each disc-like members. Suitable means capable of providing abrasive grit to the inner end of the propeller vanes is also provided. As a result of wheel rotation, abrasive grit is centrifugally propelled from the propeller vanes.

Each disc-like member of the runnerhead is case hardened and includes: side surface means; rim or land means joined to each side surface means and defining the outermost periphy of the disc; and, bevel means which joins one or more side means to the rim means. By such construction, the impingement of rebounding grit on the wheel periphery is at an angle rather than striking a flat surface. As such, the bevel means deflect the rebounding grit whereby enhancing the wearability of the disc comprising the runnerhead. Yet another salient feature of the present invention is the design of the blade slot runout. That is, at the point of intersection of the blade slot with the disc periphery, radii have been provided. Like the bevel means, the provision of radii enhances the wear characteristics because the rebound grit will not have as strong adverse effect on the radii as it would on a sharp corner. Of course, the design details provided to the disc like members of the present invention are provided prior to the case hardening process or operation.

In line with the above, a primary object of the present invention is to improve the expected life of an abrasive wheel assembly.

Another object of the present invention is to improve the wearability of an abrasive wheel assembly with minimum redesign to the design thereof.

A further object of the present invention is the provision of an abrasive wheel assembly including a replaceable runnerhead having a unique profile which prolongs the useful life of the wheel assembly without adding excessive costs thereto.

Still another object of this invention is to provide a wheel assembly having a plurality of radially disposed vanes for centrifugally propelling grit away from the rotational access of the wheel assembly and which includes simple yet effective means for redesigning wear concentration areas of the wheel.

BRIEF DESCRIPTION OF THE DRAWINGS

Having in mind the above objects and other attendant advantages that would be evident from an understanding of this disclosure the invention comprises the devices, combination and arrangements of parts as illustrated in the presently preferred form of the invention which is hereinafter set forth in detail to enable those skilled in the art to readily understand the function, operation, construction and advantages of same when read in conjunction with the accompanying drawings in which.

DETAILED DESCRIPTION OF THE PRESENT INVENTION

Figure 1:
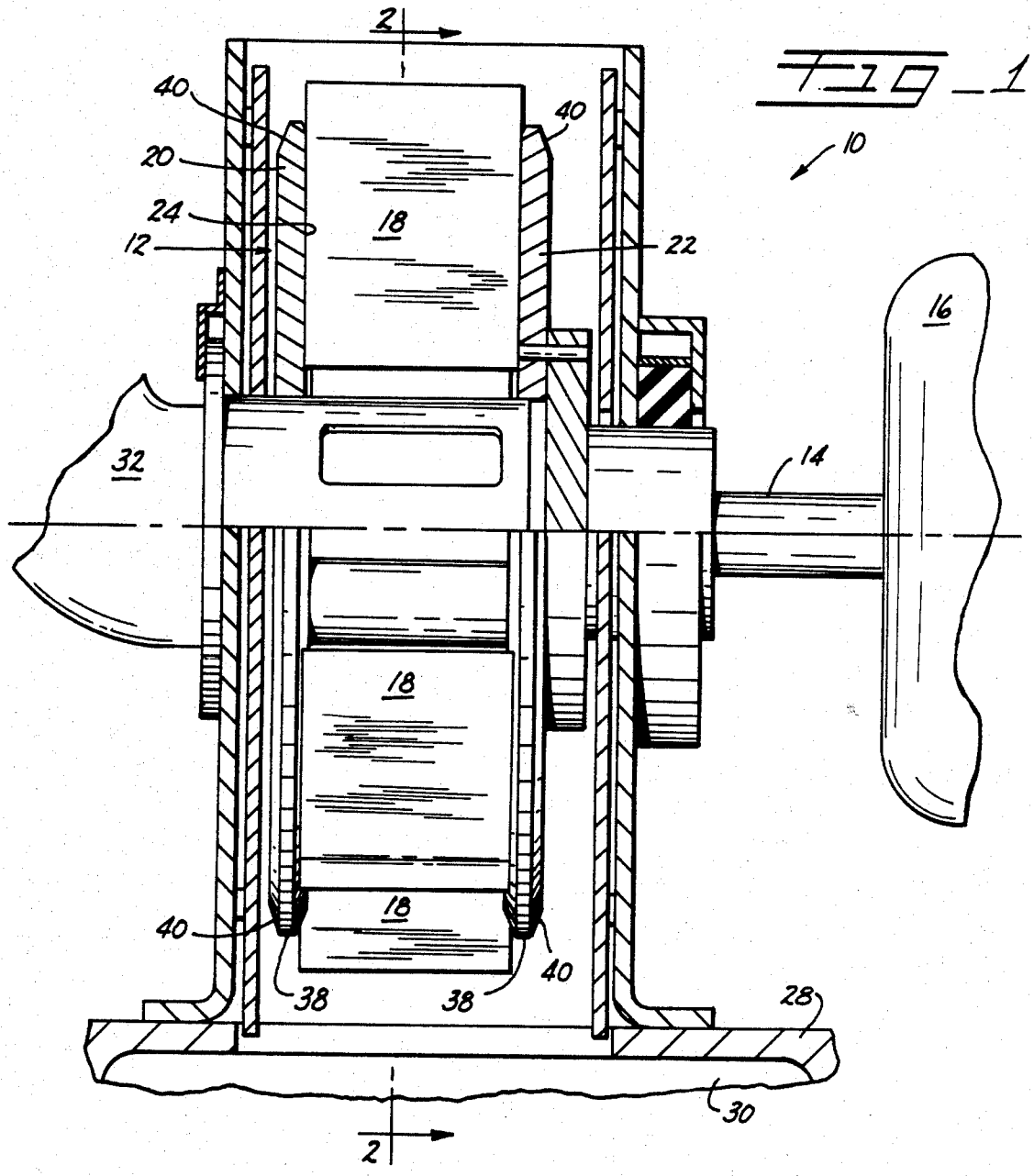
FIG. 1 is a front elevational view, partly in section, illustrating the wheel assembly of the present invention.
Figure 2:
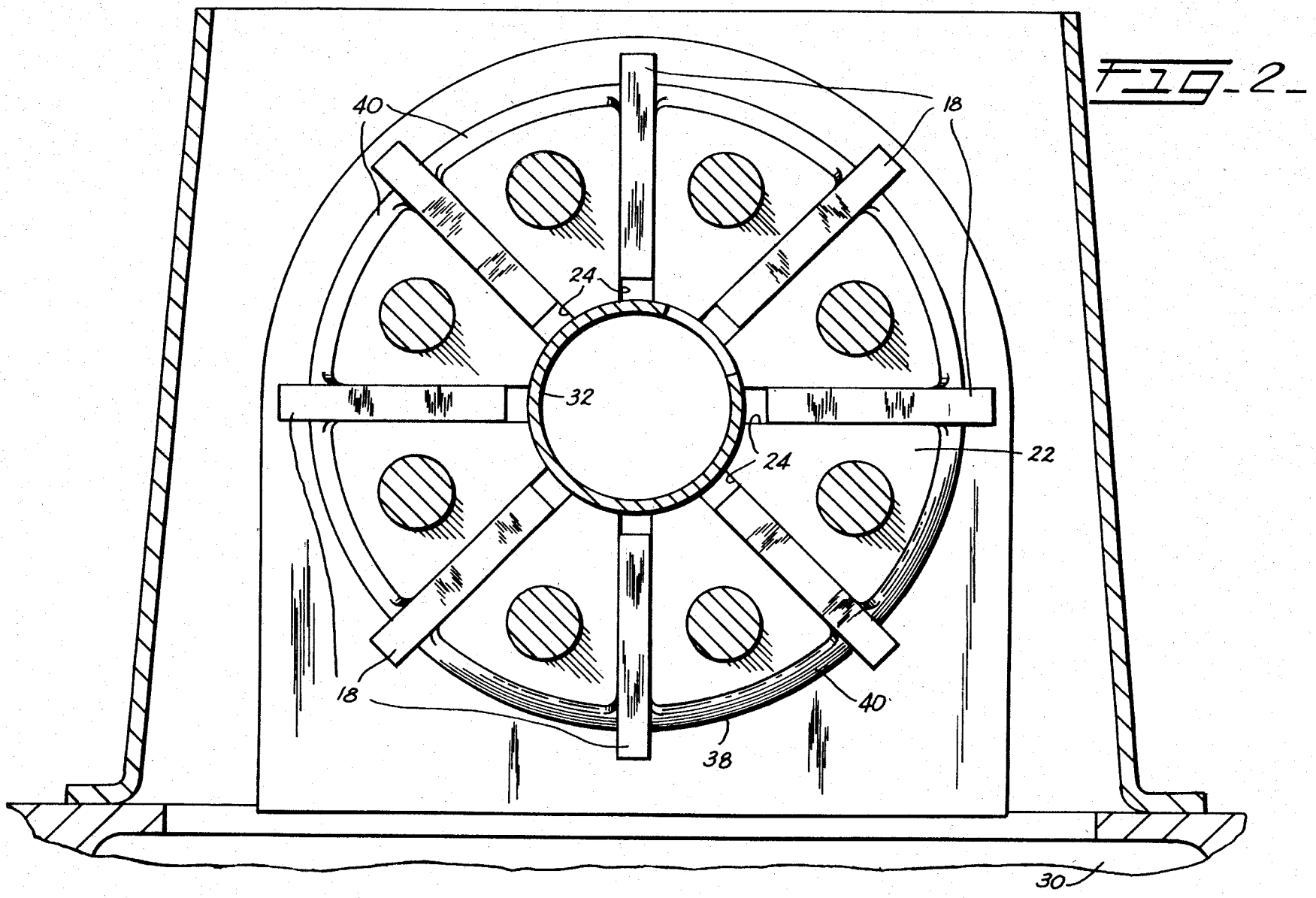
FIG. 2 is a sectional end view taken along line 2—2 of FIG. 1.

Referring now to the drawings, wherein like reference numerals indicate like parts throughout the several views, in FIG. 1 there is shown an abrasive blasting apparatus 10 including a rotatably driven wheel assembly 12. The wheel assembly 12 is suitably secured to and rotatable with a driving shaft 14. The shaft 14 may be rotatably driven by a motor 16 or other suitable means. The wheel assembly 12 includes a plurality of vanes or blades 18 which are removably secured between a pair of coaxially spaced disc-like members 20 and 22 defining a runnerhead. The impeller vanes 18 may be adjustably secured in an operative position and against radial displacement relative the runnerhead by any suitable locking means (not shown). In the illustrated embodiment, a portion of each impeller blade or vane is accomodated within a radially extending slot or groove (FIGS. 2 and 3) provided on one side surface of each disc. The slots or grooves 24 correspond in number to the vanes secured to the plate-like member. As seen in FIG. 2, the vanes or blades are spaced from each other in the central portion of the wheel assembly. That is, the propeller blades radially extend inwardly short of the rotational axis of the wheel assembly.

The above described wheel assembly pertains to the type wherein the propeller vanes are supported between two disc or plate-like members. It is, of course, possible that a single disc having dovetailed grooves for accomodating and holding each blade or vane may be used without departing from the spirit and scope of the present invention.

Albeit adjustable to alternative uses, in the embodiment of FIGS. 1 and 2, the wheel assembly 12 is encased within an apertured housing 26. The housing 26 may form part of or be used in combination with a conventional barrel blast machine 28 having a chamber 30 into which parts requiring cleaning are placed. An abrasive grit transfer mechanism 32 is provided for directing abrasive or grit material from a supply source (not shown) to the inner ends of the propeller blades 18 of the wheel assembly at a given clock dial position or zone. The abrasive grit delivered to the wheel assembly may have an RC hardness ranging as high as 62. The transfer mechanism 32 is mounted in the aperture of the housing 26 and may be operably secured thereto by any suitable clamp means. Since the salient features of the present invention relate primarily to the design of the single or double discs comprising the runnerhead the reader's kind attention is directed to U.S. Pat. No. 2,385,728 granted to P. J. Potter on Sept. 25, 1945 for a more detailed description of one kind of transfer mechanism that may be used to transfer grit to the wheel assembly.

In operation, the abrasive particles are centrifugally propelled from the blades 18 of the wheel assembly and into the chamber 30. Because the wheel assembly is rotated at speed ranging from 1,500 to 3,600 rpm, the abrasive grit is propelled into the chamber 30 with a force sufficient to clean the objects disposed therein.

Figure 5:
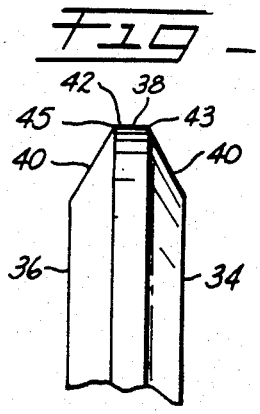
FIGS. 5 and 6 illustrate various enlarged partial profile views of the disc-like member illustrated in FIG. 3.
Figure 6:
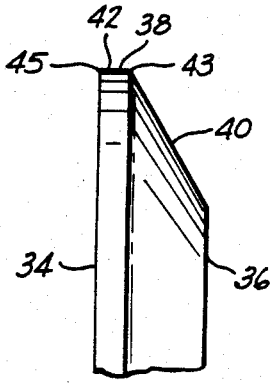

Each plate-like or disc member 20 or 22 comprising the runnerhead is made from an alloy steel material which lends itself to subsequent case hardening operations. An 8620 alloy steel has been found desirable in many applications. As best illustrated in FIGS. 5 and 6, the disc members comprising the runnerhead each have spaced apart side surfaces 34 and 36, rim means 38 joined to the side surface means 34 and 36 and defining the outermost radial edge of each plate-like member, and one or more bevel or chamfer means 40 which join the rim means with the side surfaces of the plate like disc. In the embodiment illustrated in FIG. 5 the bevel or chamfer means slant inwardly from the side surface toward the rim means. As is apparent from FIGS. 5 and 6, however, the bevel or chamfer means may take a combination of several configurations. As seen in FIGS. 5 and 6, the rim means may include a narrow land 42 defined between the outermost radial edges 43 and 45 of the disc-like member.

Figure 4:
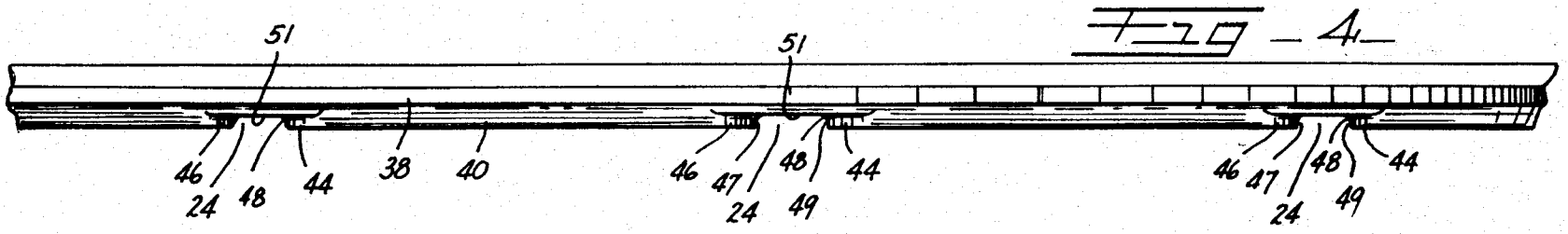
FIG. 4 is a plan view of the disc-like member illustrated in FIG. 3.
Figure 3:
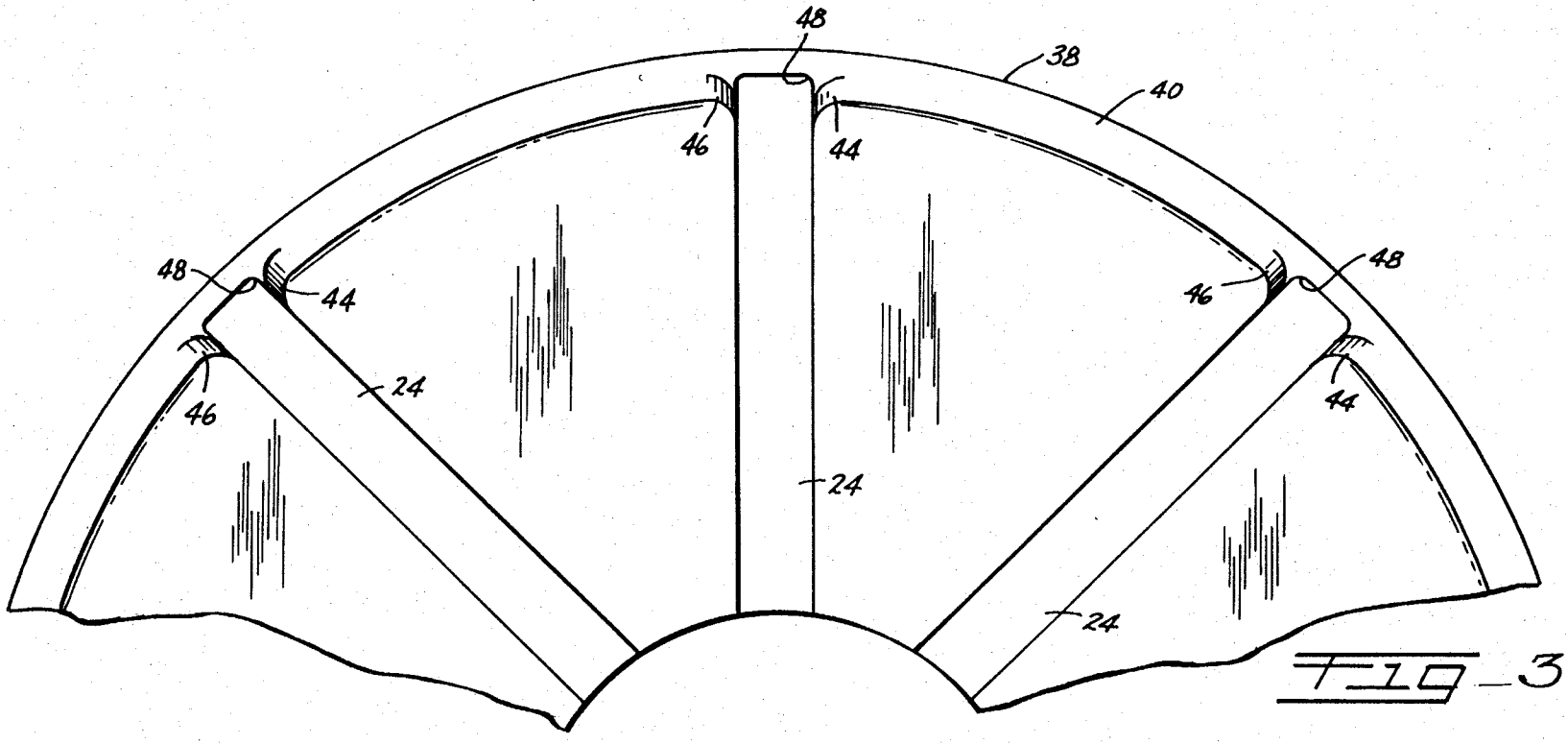
FIG. 3 is an enlarged partial end view of one disc-like member included in the present invention.

Amongst the unique offerings provided by the present invention is the improved configuration of the slot or groove means 24 used to accomodate the blades or vanes 18. As apparent from FIGS. 2 and 3, each groove 24 extends across the entire radial width of the disc-like member. That is, each groove extends from a radial inward location on the disc member to the outer periphery thereof defined as the blade slot runout. As seen in FIG. 4, each groove 24 has opposed blade confining surface means 47 and 49 which extend back from a side surface of the disc and which are joined by a back surface 51. Normally, the groove or slot 24 would intersect with the periphery of the disc to define a relatively sharp corner along the line of intersection. It has been found, however, that a conventionally designed wheel or disc usually starts to wear or deteriorate on the outer rim at a point immediately adjacent the blade slot runout. That is, the wheel or disc begins to wear at a point immediately following the point whereat the blade slot intersects with the outer periphery of the wheel. In order to retard this deteriorative effect, and as best illustrated in FIGS. 3 and 4, the slot configuration of the present invention has been redesigned such that a plurality of radii 44 and 46 are disposed at the outermost radial edge of the slot, that is, where the slot or groove 24 intersects the disc periphery. Any suitably sized radius should suffice. Moreover, a smaller radius or chamfer 48 is provided where the blade engaging surfaces 47 and 49 join the back surface 51.

The unique configuration of the discs and their grooves offers several unique advantages to the overall performance of the wheel assembly. First, the chamfer or bevel means 40 improves the wear characteristics of the disc-like members. That is, because of the slanted bevel means, rebounding grit which normally impinges against and wears at the periphery of the wheel cannot impinge against the entire radial width of the disc. Instead, rebounding grit is deflected by the bevel means with less destruction being done to the disc periphery. Second, the radii 44 and 46 which lead radially away from the groove 24 provide a similar deflection quality to that provided by the bevel means 40. As such, the wearability of the disc may be significantly improved. Finally, the unique configuration or design provided by the present invention to the disc of the runnerhead improves subsequent case hardening procedures for the disc. That is, once the plate-like member has been fabricated into its preferred form each plate is case hardened. Preferrably, a heat treating carborization process or operation is used to case harden the disc with its core remaining relatively soft. If the outer ring of the disc-like member remains flat from one side surface to the other side surface (i.e, absent any bevel or chamfer means), the heat treat carborization process imparts a case hardening which penetrates evenly across the flat rim to approximately a 0.090" depth. In contrast, the chamfered or bevel design of the present invention yields or achieves a deeper and thus longer lasting case hardening effect during the heat treating carborization process. When a deeper and longer lasting case hardening is provided on each of the discs, of course, the useful life of the disc comprising the runnerhead of the wheel assembly will naturally be prolonged.

Thus, there has been provided and IMPROVED WHEEL ASSEMBLY FOR AN ABRASIVE BLASTING APPARATUS which fully satisfies the objects, aims and advantages set forth above. While the invention has been described in connection with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

Thus, having adequately described my invention, what I claim is:

1. A wheel assembly for an abrasive blasting apparatus comprising:

a driven disc-like wheel capable of rotation about an axis and including in combination, a plurality of radial vanes adjustably connected to said wheel and terminating inwardly short of the rotational axis of said wheel, means for providing grit to the inner ends of said vanes, with said wheel having two spaced radially extending side surfaces and a plurality of grooves radially extending across at least one of said side surfaces for accommodating a portion of each vane, a wheel rim joined to each of said side surfaces, and at least one bevel portion which joins one of said side surfaces with said wheel rim, wherein said radially extending grooves intersect with the bevel portion in a manner defining a groove runout.

2. The invention according to claim 1 wherein said grooves extend across the entire radial width of said disc-like wheel and intersect with the bevel means to define a groove runout.

3. The invention according to claim 1 wherein each of said grooves includes two opposed surfaces extending from one of said side surfaces on said disc-like members and which are joined by a back surface.

4. The invention according to claim 3 wherein each of said side surface means has radially configured surfaces at the groove runout.

5. An improved abrasive blasting wheel assembly of the type having a plurality of radially extending blade members disposed along radii of the wheel assembly for centrifugally propelling abrasive grit delivered to inner ends of said blade members, wherein said wheel assembly comprises:

a rotary driven disc-like wheel having a radial outermost edge and two spaced, substantially parallel radially extending side surfaces, with one side surface having a plurality of radially extending grooves which slidably accommodate a portion of each blade member, an inwardly directed chamfer extending from each side surface to the radial outermost edge of the wheel in a manner defining a land on the radial outermost edge of said wheel between outermost edges of said chamfers, and wherein said grooves intersect with one of said chamfers in a manner defining a groove runout.

6. An improved abrasive blasting wheel assembly of the type having a plurality of radially extending blade members disposed along radii of the wheel assembly for centrifugally propelling abrasive grit delivered to the inner ends of said blades, wherein said wheel assembly comprise:

at least two coaxially spaced rotationally driven wheels having defined on facing sides of each a plurality of radially extending opposing blade member receipt slots each adapted to receive in sliding relationship one of said plurality of blades, each driven wheel having a circumferential edge and two spaced substantially parallel radially extending surfaces defining substantially entire side surfaces of said wheels, with said blade member receipt slots being provided on at least one side of each wheel, and a bevel inwardly extending from each side surface to the circumferential edge of the wheel in a manner defining a relatively narrow land on the circumferential edge of said wheel between outermost edges of said bevels such that when said wheels are fabricated and subsequently case hardened the provision of said bevels and land enhances the case hardening effect imparted to the circumferential edge of the wheel.

* * * * *